United States Patent [19]

Franck et al.

[11] Patent Number: 4,662,679

[45] Date of Patent: May 5, 1987

[54] VARIABLE SEATING ARRANGEMENT

[75] Inventors: Klaus Franck, Hanover; Werner Saaer, Springe, both of Fed. Rep. of Germany

[73] Assignee: Wilkhahn, Wilkening & Hahne GmbH & Co., Bad Munder, Fed. Rep. of Germany

[21] Appl. No.: 786,733

[22] Filed: Oct. 11, 1985

[30] Foreign Application Priority Data

Oct. 25, 1984 [DE] Fed. Rep. of Germany ..... 3439135

[51] Int. Cl.[4] ..... A47C 15/00

[52] U.S. Cl. ..... 297/240; 297/249; 297/349

[58] Field of Search ..... 297/249, 248, 240, 241, 297/242, 349; 248/416

[56] References Cited

U.S. PATENT DOCUMENTS

| | | | |
|---|---|---|---|
| 2,848,037 | 8/1958 | MacKnight | 297/240 |
| 3,002,787 | 10/1961 | Ziegenfuss | 297/249 |
| 3,146,025 | 8/1964 | Heaney | 297/248 |
| 3,186,761 | 6/1965 | Propst | 297/349 |
| 3,261,640 | 7/1966 | Straits | 297/248 |
| 4,023,760 | 5/1977 | Robinson | 248/416 |
| 4,226,398 | 10/1980 | Freber | 297/349 |
| 4,238,135 | 12/1980 | Sandham | 297/349 |

*Primary Examiner*—Francis K. Zugel

*Attorney, Agent, or Firm*—Learman & McCulloch

[57] ABSTRACT

The invention relates to a variable seating arrangement with a plurality of seating elements which are supported by at least two approximately horizontal support elements (1, 1') the adjacent ends (1*a*, 1'*a*) of which are connected to one another in a common connecting column (4) and are pivotable relative to one another about a vertical shaft (6). In this way an extremely large number of arrangements and groupings of the seating elements relative to one another are possible.

6 Claims, 3 Drawing Figures

VARIABLE SEATING ARRANGEMENT

The invention relates to a variable seating arrangement with a plurality of seating elements.

In conference rooms, hotel foyers, ticket halls, rest rooms and the like it is frequently necessary to arrange seating elements together in different ways and for different purposes, for example for discussions among a number of people or simply in order to provide groups of seats for people who are waiting.

For these and other purposes it is generally known for example for chairs, sofas, benches and the like to be arranged together in a suitable manner, so that adjacent ends of seats or rows of seats can be connected to each other for example by suitably adapted support plates.

The object of the invention is to provide a variable seating arrangement of the type set out in the introduction which is made up of relatively simple parts and permits a large number of seat groupings and arrangements and also easy and quick regrouping of the seating elements relative to one another.

This object is achieved according to the invention by the features set out in claim 1.

If this variable seating arrangement according to the invention consists for example of two support elements which extend essentially horizontally and on which one or more seating elements can be arranged, these support elements are supported at their ends against the floor, and advantageously the ends of the two support elements which are adjacent to one another are connected to each other by a joint arranged in a common connecting column and are pivotable relative to one another about a vertical shaft. This means of support and pivot connection therefore makes it possible to position two adjacent horizontal support elements at practically any angle relative to one another, i.e. these two support elements with the seating elements supported on them can be positioned at an angle to one another or in a straight row. Comparatively few structural elements are necesary for this, and the adjustment to a new grouping or arrangement of the seating can be carried out quickly and without the aid of any tools or other accessories.

In a particularly advantageous manner any number of more than two support elements can be provided, two adjacent support elements in each case being connected to one another in the common connecting column so as to be pivotable relative to one another. In this way an extraordinarily large variety of groupings and arrangements of the seating can be provided, so that it is possible to create different ground plan combinations, specific pathways, clearly defined areas of large rooms, but also small groups, any solutions to corners and spacious scenery to dominate a room, and so that it always remains possible to regroup or rearrange the seating elements in the manner desired in each case. It is also possible for the seating arrangements to be arranged uniformly as regards the individual seating elements or groups of seating elements, i.e. essentially in one direction, or alternately, i.e. in opposing directions on adjacent support elements.

Further details of the invention are set out in the other subordinate claims and in the following description of an embodiment which is illustrated in the drawings.

Figure 1:
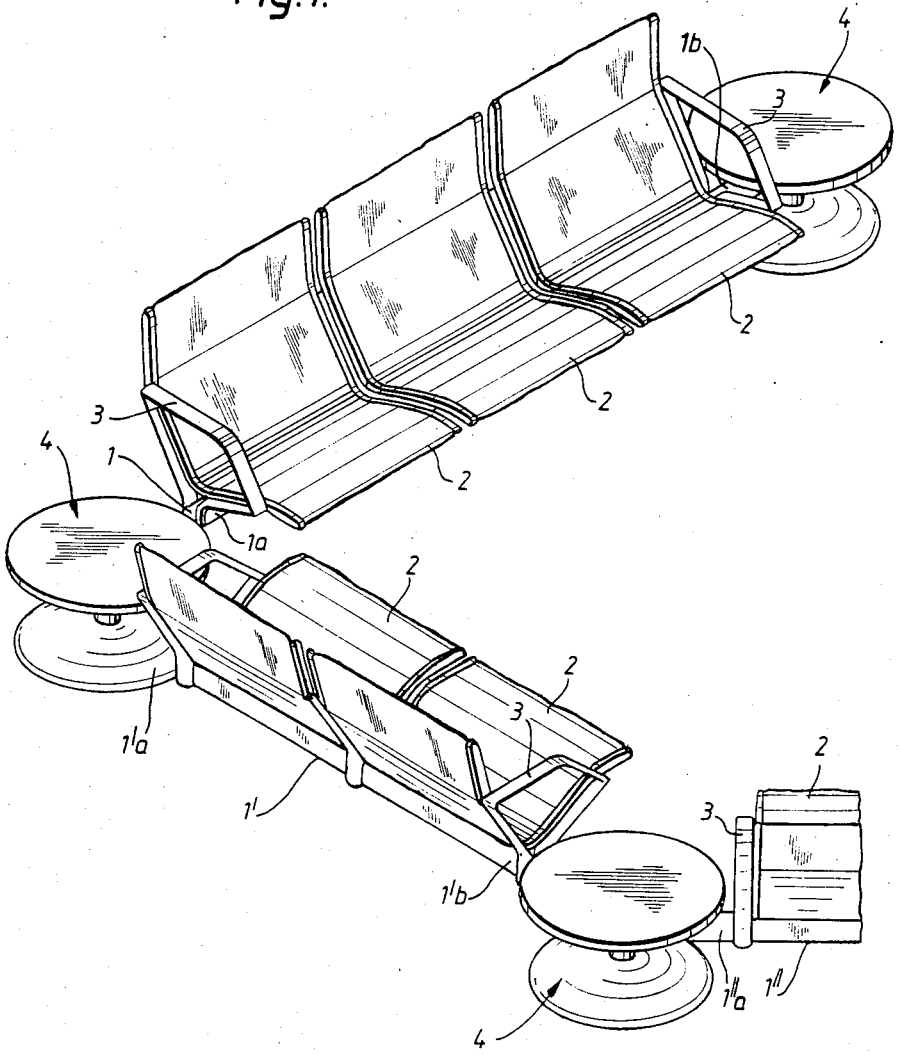
FIG. 1 shows a perspective view of the variable seating arrangement with support elements (with seating elements arranged thereon) positioned at an angle to one another.

A complete arrangement of the example of the variable seating arrangement which is to be described can be seen in the perspective view according to FIG. 1. The seating arrangement illustrated here contains at least two essentially horizontally extending support elements, i.e. in this representation two support elements 1, 1' are indicated in their full length whilst a third support element 1'' is only partly indicated. A suitable number of seating elements 2 (but at least one such seating element) is supported by each support element 1, 1', 1''. In this embodiment the seating elements 2 are constructed in the form of individual or connected chair elements, as can be easily seen from FIG. 1. These seating elements 2 can be fixed in any suitable manner on the appertaining support element 1, 1', 1'', for example by simple clamping or screw fixing, in certain circumstances with the aid of clips or the like which are not explained in greater detail. Conventional arm rests can be provided at the ends of a group of seating elements or additionally between two adjacent seating elements 2, and at the same time these arm rests can be so constructed that they produce the connection between the relevant seating elements 2 and the support element 1, 1', 1''.

In the illustrated embodiment one end 1*a* and 1'*a*, i.e. the ends adjacent to one another, of each of the two support elements 1, 1' is supported pivotably in a common connecting column 4. For this purpose the said two ends 1*a*, 1'*a* of the support elements are connected to each other-cf. also FIG. 2—by a connecting joint 5 arranged in this common connecting column 4 (as is explained in greater detail with the aid of FIG. 3). In this way the ends 1*a* and 1'*a* of these support elements are not only supported in the common connecting column 4 but are also pivotable relative to one another about a vertical shaft 6 of this connecting joint 5, so that accordingly the appertaining support elements 1, 1' can also be pivoted at an angle to one another.

A similarly constructed connecting column 4 also connects the other end 1'*b* of the support element 1' to the adjacent end 1''*a* of the third support element 1'', so that these two support elements 1' and 1'' can also be pivoted at an angle to one another.

The other end 1*b* of the support element can also be arranged and supported in a similar connecting column 4. In this way all supporting columns for the ends of the support elements can be designed and produced in the same way, and it is always possible for the end 1*b* of the support element 1 to be pivotably connected at any time to a further support element by means of the connecting joint in the appertaining connecting column 4. Thus in the case of a larger number of support elements two adjacent support elements in each case are connected to one another in the common connecting joint 4 so as to be pivotable relative to one another.

Figure 2:
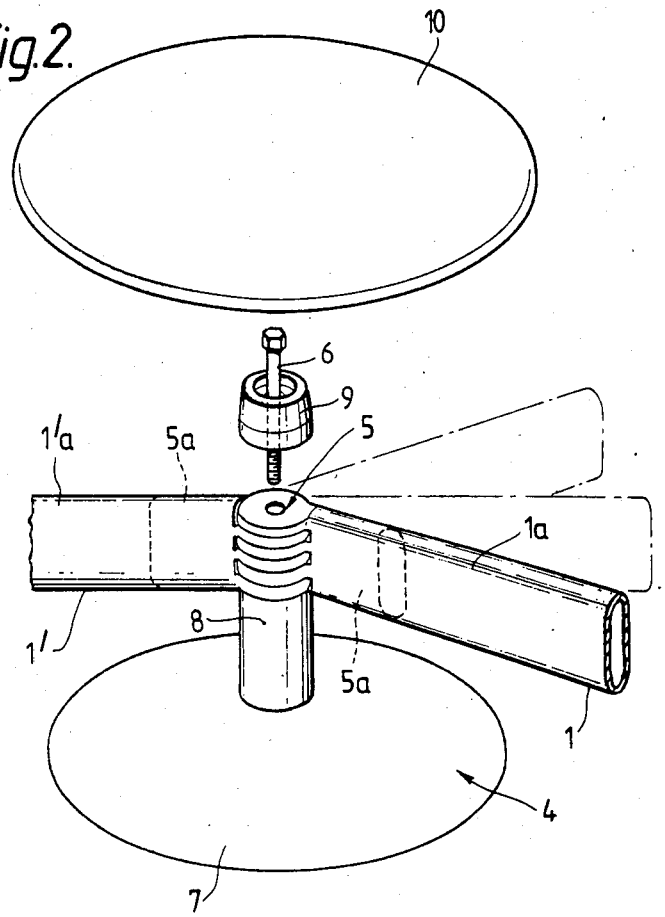
FIG. 2 shows a partially exploded perspective view of a connecting column with the ends of two support elements positioned so as to pivot relative to one another.

The construction of a connecting column 4 with the connecting joint 5 arranged therein will be described in greater detail below with the aid of FIGS. 2 and 3, and it should again be emphasised that all connecting columns 4 can preferably be of the same construction.

The connecting column 4 contains the following essential parts in addition to the connecting joint 5: a base 7 which is of sufficiently large dimensions and preferably round, a vertically aligned supporting tube 8 at the upper end of which the connecting joint 5 with the vertical shaft 6 is connected, an upper connecting cone 9 arranged on the upper end of the connecting joint 5, and a table top 10 placed and retained on this connecting cone 9. Accordingly the connecting joint 5 is arranged between the upper connecting cone 9 and the supporting tube 8, and the vertical shaft 6 also extends between the upper end 8*a* of the supporting tube 8 and the lower end 9*a* of the connecting cone 9. The shaft 6 is preferably constructed in the form of a sufficiently long connecting bolt, the hexagon head 6*a* of which is supported by a tightening disc 11 in the connecting cone 9 whilst its lower threaded end 6*b* is screwed into the upper end 8*a* of the supporting tube 8.

Figure 3:
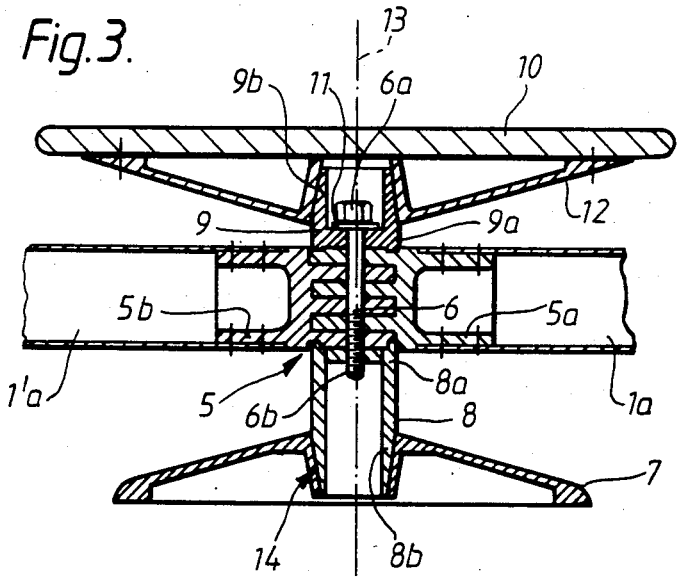
FIG. 3 shows a vertical sectional view through a complete assembled connecting column with ends of support elements supported therein.

The table top 10 can be placed (with or without additional fixing means) onto the upper end 9*b* of the connecting cone 9 either directly or with the interposition of a table top support 12, and in the latter case—as indicated in FIG. 3—can be fixed, preferably screwed, onto the upper surface of the table top support 12.

The connecting joint 5 is basically formed by two interengaging joint parts 5*a* and 5*b* each provided on one of the appertaining ends 1*a* or 1'*a* of the support elements and by the shaft formed by the connecting bolt 6.

This means that the two joint parts 5*a* and 5*b* can basically be formed directly, i.e. integrally, on the appertaining end 1*a* or 1'*a* respectively of the support elements. However, it is preferable for the two interengaging joint parts 5*a* and 5*b* to be formed by two similar castings which are fixed on alternate sides of the appertaining support element ends 1*a* and 1'*a* respectively. The joint parts 5*a* and 5*b* of each connecting joint 5 thus produced can be fixed particuarly simply and reliably on the appertaining support element end 1*a* or 1'*a* if each support element 1, 1', 1'' is preferably produced essentially from a tube which is approximately flat-oval in cross-section and aligned on its edge, as can be seen in the right-hand support element 1*a* in FIG. 2. The joint parts 5*a* and 5*b* can be fixed on the appertaining ends 1*a*, 1'*a* respectively of the support elements in any suitable manner, for example by pins, rivets, screws or the like (as is indicated schematically in FIG. 3).

The construction of the support elements 1, 1', 1'' as approximately flat-oval tubes aligned on their edges also simplifies the attachment and fixing of the seating elements 2 since they can be retained essentially so as to be protected against torsion on the support elements constructed as described, as is indicated for example in FIG. 1.

With regard to the design and construction of the connecting column 4 it should also be mentioned that a roughly circular or approximately round symmetrical shape is generally preferred for the surface of the table top 10 and the base 7, so that the base 7, the supporting tube 8, the connecting joint 5 with the shaft 6, the upper connecting cone 9, the table top support 12 and the table top 10 can then be arranged essentially coaxially above one another (cf. the vertical central axis 13). Naturally, other suitable plan forms for the table top 10 and the base 7 are also envisaged. The base 7 which is preferably constructed in the form of a flat conical base can be reliably connected to the lower end 8*b* of the supporting tube 8 by a cone connection which is known per se (as indicated at 14).

We claim:

1. In a variable seating arrangement having a plurality of seating elements, the improvement comprising at least two horizontally extending linear support elements, at least one seating element attached along the upper surface of each of said support elements fixed thereto against torsion about the longitudinal axis thereof and forming a seat assembly, a connecting column at each end of each support element including a common connecting column between adjoining seat assemblies of a common seating arrangement, and a connecting joint between each end of each such support element and the connecting columns at corresponding ends thereof cooperating coaxially to permit relative pivoting movement of each support element about the vertical axis of the connecting column while restricting torsional movement between each such support element and the connecting column, each horizontally extending support element maintaining the respective connecting column in a vertical position, whereby each multiple seat assembly is carried solely by a single support element and the adjoining connecting columns at its ends, and seat assemblies sharing a common connecting column are relatively pivotable thereabout for variable arrangements as desired.

2. Seating arrangement as claimed in claim 1, characterised in that the connecting column includes a base, a vertical supporting tube and an upper connecting cone, and between said upper connecting cone and the supporting tube, the connecting joint and a vertical shaft constructed in the form of a connecting bolt are arranged.

3. Seating arrangement as claimed in claim 2, characterised in that the connecting joint is formed by two interengaging joint parts which are each provided on one end of a support element and by the connecting bolt which connects the upper connecting cone to the vertical supporting tube.

4. Seating arrangement as claimed in claim 3, characterised in that the interengaging joint parts are formed by two similar castings which are fixed on alternate sides of the appertaining end of the support element.

5. Seating arrangement as claimed in claim 1, characterised in that each support element essentially consists of a tube which is approximately flat-oval in cross-section and aligned on its edge with a joint part fixed on each end.

6. Seating arrangement as claimed in claim 1, characterised in that the seating element fixed on each support element are constructed in the form of individual or linked chair elements.

* * * * *